US006703545B2

(12) United States Patent
McFerson

(10) Patent No.: US 6,703,545 B2
(45) Date of Patent: Mar. 9, 2004

(54) VIOLIN

(76) Inventor: Mathew A. McFerson, 19055 Incline Rd., Norwalk, WI (US) 54648

( * ) Notice: Subject to any disclaimer, the term of this patent is extended or adjusted under 35 U.S.C. 154(b) by 0 days.

(21) Appl. No.: 10/155,604

(22) Filed: May 22, 2002

(65) Prior Publication Data

US 2003/0217633 A1 Nov. 27, 2003

(51) Int. Cl.[7] ..... G10D 1/02
(52) U.S. Cl. ..... 84/274; 84/275; 84/297 R; 84/299; 84/302; 84/300; 84/301
(58) Field of Search ..... 84/274–275, 297 R, 84/299–302

(56) References Cited

U.S. PATENT DOCUMENTS

| | | | | | |
|---|---|---|---|---|---|
| 2,064,925 | A | | 12/1936 | Kolitsch | 84/280 |
| 2,414,238 | A | | 1/1947 | Osburn | 84/263 |
| 2,489,101 | A | | 11/1949 | Mills | 84/280 |
| 2,539,645 | A | * | 1/1951 | Ulvick | 84/302 |
| 2,591,164 | A | | 4/1952 | Klein | 84/280 |
| 2,709,388 | A | * | 5/1955 | Allers | 84/299 |
| 2,747,452 | A | | 5/1956 | Goldberger | 84/280 |
| 2,877,678 | A | * | 3/1959 | Infeld | 84/302 |
| 3,831,485 | A | * | 8/1974 | Dopera | 84/275 |
| 3,964,362 | A | * | 6/1976 | Quemore, Sr. | 84/173 |
| 3,981,219 | A | | 9/1976 | Johns | 84/275 |
| 4,224,857 | A | * | 9/1980 | Infeld | 84/302 |
| 5,171,926 | A | | 12/1992 | Besnainou et al. | 84/275 |
| 5,408,912 | A | | 4/1995 | Baity et al. | 84/307 |
| 5,734,117 | A | | 3/1998 | Tanzella | 84/309 |
| D403,013 | S | | 12/1998 | Honda | D17/17 |
| 6,018,120 | A | | 1/2000 | Steinberger | 84/731 |
| 6,031,163 | A | | 2/2000 | Cullum et al. | 84/279 |
| 6,291,750 | B1 | | 9/2001 | Farha | 84/278 |

FOREIGN PATENT DOCUMENTS

| | | |
|---|---|---|
| FR | 2 661 539 | 4/1990 |

OTHER PUBLICATIONS

J.B. Vuillaume, Roger Millant. W.E. Hill & Sons London, ©1972 W.E. Hill & Sons, London W.I, England.

* cited by examiner

*Primary Examiner*—Shih-Yung Hsieh
(74) *Attorney, Agent, or Firm*—Vidas, Arrett&Steinkraus PA

(57) ABSTRACT

A bow stringed instrument having an anchor piece which secures the strings to the top plate of the instrument, wherein strings are connected to the anchor piece and the anchor piece is attached to the top plate.

19 Claims, 3 Drawing Sheets

VIOLIN

FIELD OF THE INVENTION

The present invention relates to hollow bodied bowed string instruments such as standing bass, violin/fiddles and cellos. More particularly, the present invention relates to a device to replace the standard tail piece to connect the strings to the sound box.

BACKGROUND OF THE INVENTION

Hollow body bow stringed instruments are well known and have well established construction techniques. These types of instruments are made up of more than 70 parts, all of which are typically made of wood, except for the strings and tail-piece fastenings. The wood pieces are glued together to form the instrument.

Such instruments include a sound box having a finger board connected thereto. The strings are attached to an end of the finger board and to a tail piece, which is in turn attached to the rear of the instrument via fastenings. Nothing is actually attached to the top plate of the sound box. This fastening scheme supports the pressure imparted on the instrument due to the tension of the strings.

These instruments produce their sound when the string begins to vibrate. The string vibrations are sent through the bridge, which transmits them to the top of the instrument. A sound post under the bridge transmits the vibrations to the back of the instrument.

The beautiful sound produced by the members of the violin family depends on all the parts of the instrument vibrating freely. Instrument makers have experimented over the centuries to create the best shape for the instrument and to find the best wood to maximize the vibrations. The present invention has expanded upon this evolution by improving the sound quality.

All US patents and applications all other published documents mentioned anywhere in this application are incorporated herein by reference in their entirety.

Without limiting the scope of the invention in any way, the invention is briefly summarized in some of its aspects below.

SUMMARY

The present invention is directed toward hollow bodied bow string instruments. It relates to the method used to attach the instruments strings at the end opposite the adjustment or tuning mechanisms. Instead of using a tail piece used in convention violins, the present invention uses an anchor piece which is attached directly to the top of the instrument. The anchor piece also comprises a secondary bridge for the strings. The present invention places additional energy into the top of the instrument producing acoustical benefits. The extra pressure placed on the top plate makes it more responsive, as well as louder.

BRIEF DESCRIPTION OF THE ATTACHED DRAWINGS

FIGS. 1*a–b* are top and side views of a conventional violin;

DETAILED DESCRIPTION OF THE EMBODIMENT

A detailed description of illustrative embodiments of the violin according to the invention is given herein below with reference to the attached drawings, and possible modifications are discussed by way of conclusion.

The following statement applies to the whole of the description. If, for the purposes of clarity of the drawings, reference numbers are included in a figure but are not mentioned in the directly associated text of the description, then reference is made to their mention in preceding figure descriptions. In the interests of intelligibility, the repeated designation of components in succeeding figures is for the most part omitted, if it is clear from the drawings that the components concerned are "recurring" components.

Due to the multiple novel features disclosed herein, it should be understood that individual features of the embodiments may stand alone as improvement or may be combined with each other in multiple configurations where physically possible. The proportional representation illustrated by the figures also represents structural disclosure of various embodiments.

Elements not identified in a particular figure are readily identifiably via their identification in other figures.

Figure 1A:
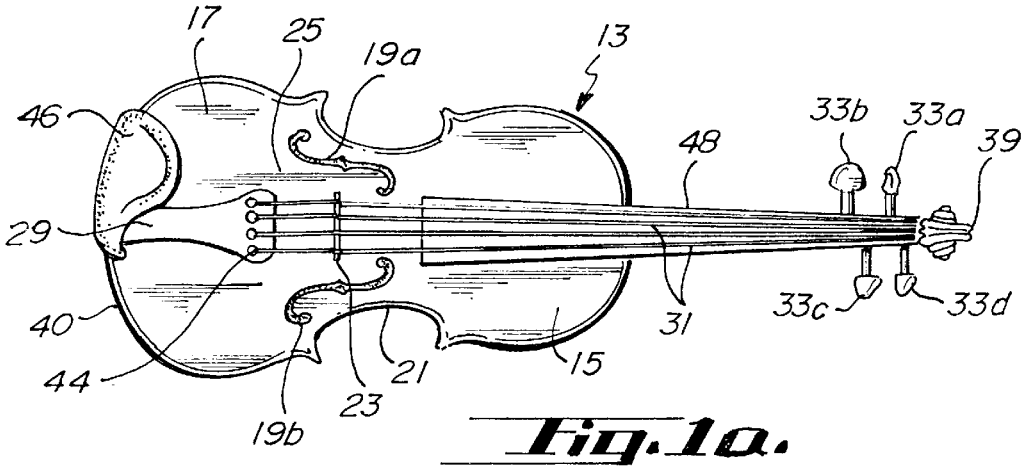
fig. 1a. PRIOR ART
Figure 1B:
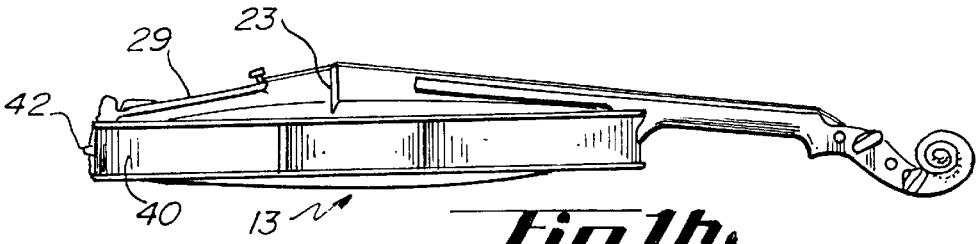
fig 1b. PRIOR ART

FIGS. 1*a*–1*b* show a conventional violin for purposes of illustrating the general parts of a violin. In FIG. 1 there is shown a top view of a typical violin 11 having a sound body or "box" 13 having, typically, an upper section 15 and a lower section 17. Sound boxes 13 of "hollow body" violins, as apposed to electric violins, are substantially hollow to produce the violin sound. Conventionally f-shaped sound holes or orifices 19 are provided in the central section of the sound box adjacent to and somewhat downwardly displaced from the wasp waist 21 of the sound box. The f-shaped sound holes 19*a* and 19*b* are conventionally bracketed about the section in which a bridge 23 is normally mounted upon the upper surface 25 of the sound box. The bridge 23, may take many shapes, but usually has a slightly arcuate shape with an arcuate upper portion with notches in which the strings are mounted and frequently two outboard feet on the bottom which directly contact the upper surface 25 of the violin. There are a number of patents directed to bridges of various shapes and designs, each one having certain advantages and disadvantages with respect to the others.

The bridge 23 is conventionally urged against the surface 25 of the upper portion of the sound box 13 by the tension in the strings 31 which are secured in their lower portion to the upper part of the tailpiece 29 which is mounted upon the surface 25 of the violin. The strings 31 of which there are conventionally four (4) including the G-string on the left, closest to sound hole 19*a*, the D-string next to the G-string, the A-string next to the D-string, and the E-string on the extreme far right.

The tailpiece 29 is attached at one end to the end 40 of the violin via a brace 42, which are well known. Such braces are typically associated with a chin rest 46. Correspondingly, the strings 31 are attached to the remaining end of the tailpiece 29 in a tensioning manner. Each string 31 is attached to the tailpiece 29 and has a fine tuning knob 44 communicating therewith for the fine tuning of the strings 31. Notice that the tailpiece 29 is not attached to the surface 25 of the violin sound box 13.

The G-, D-, A- and E-strings extend from the tailpiece 29 across the bridge 23, as indicated, and are attached to a series of tuning pegs 33*a*, 33*b*, 33*c*, and 33*d* which, by turning, are able to tune the individual strings G-, D-, A- and E-strings by turning the tuning pegs 33. The tuning pegs 33 are mounted on a finger board 48, which is attached to the sound box 13 and which terminates at the scroll 39. The tuning pegs are sufficiently stiff in their rotational movement so that they will not easily give up their tension with respect to the tension in the strings attached to their small diameter winding sections, but can be fairly easily turned by the fingers of the musician because of the relative leverage relationship.

Figure 2:
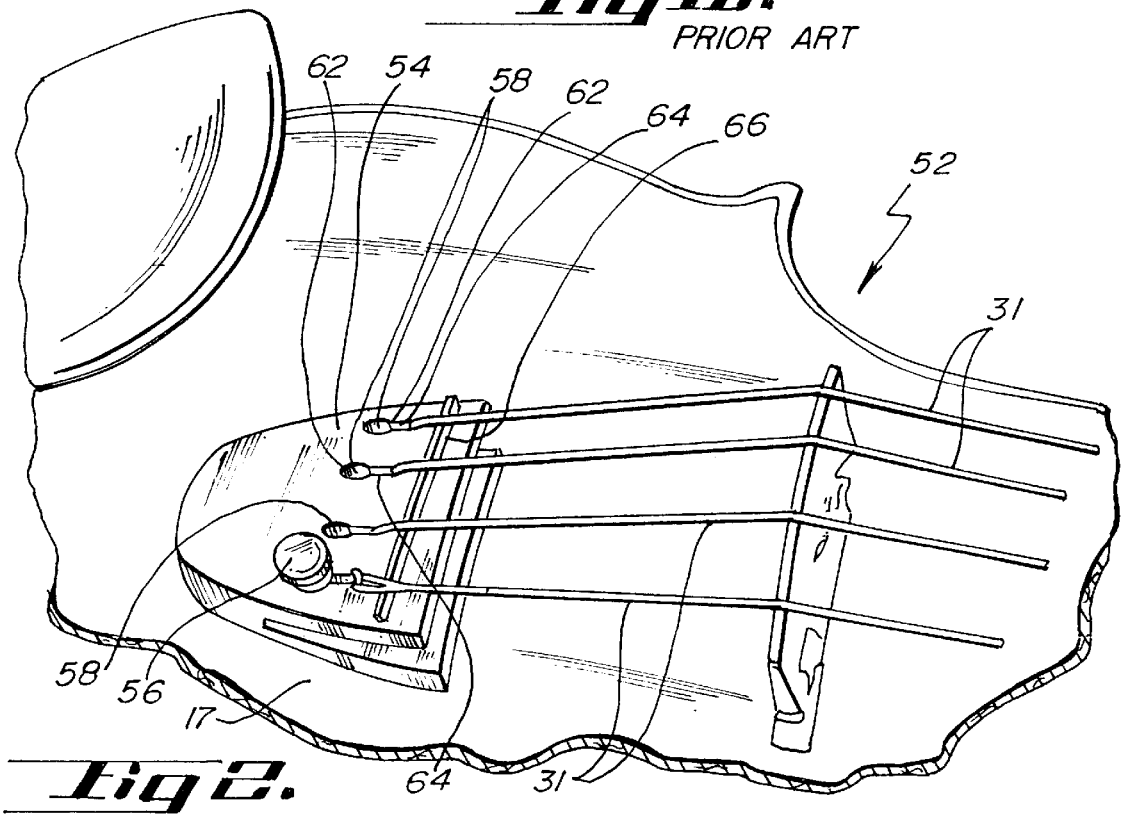
FIG. 2 shows a perspective view of the an embodiment of the present invention.
Figure 3:
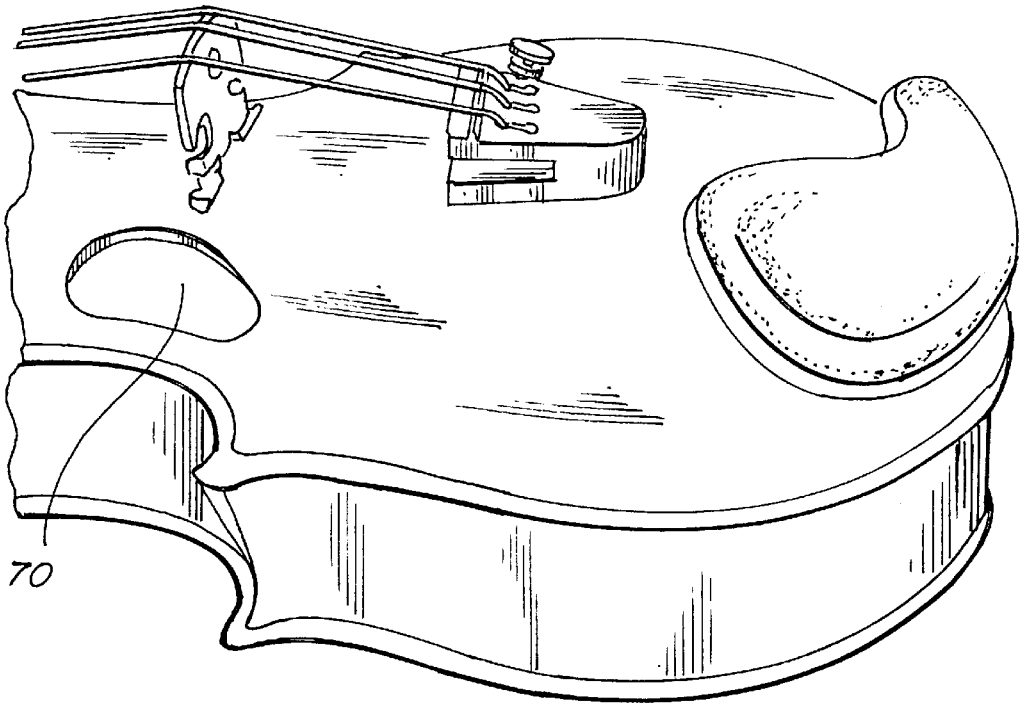
FIG. 3 shows a perspective view of the an embodiment of the present invention.
Figure 4:
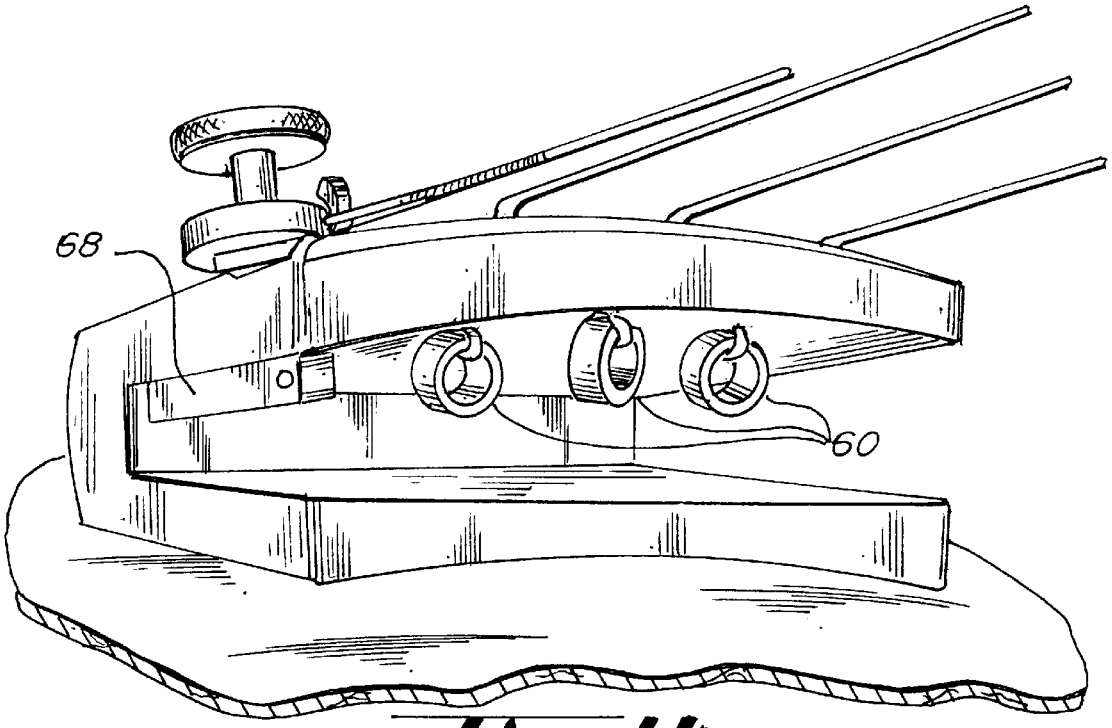
FIG. 4 shows a perspective view of the an embodiment of the present invention.

The remaining figures illustrate the novel features of the present invention. The figures show a hollow body violin 52. In a preferred embodiment, violin 52 replaces the elongated tailpiece 29 with an anchor piece 54 mounted or disposed on body 52, as illustrated in FIGS. 2–4. The anchor piece 54 is attached directly to the sound board portion 17 via adhesive, screws, posts or the like. Strings 31 are removably attached to body 52 by being removably attached to anchor piece 54, which in turn is securely attached to portion 17. The anchor piece 54 can be formed of any conventional material, but is preferably made of a hard dense wood such as ebony.

Anchor piece 54 may comprise a fine-tuning knob 56, corresponding to the E string. The fine tuning knob 56 functions to permit fine tuning (such as by rotating by hand or other suitable means) of the E string after gross tuning thereof using peg 33*c*.

The G, D and A strings are secured to the anchor piece 54 via keyhole slots 58. The keyhole slots 58 have an eye portion 62 and a slot portion 64. To engage the strings 31, the strings 31 are fastened to a ringlet or bead 60, which may be seen in later figures. Ringlet 60 is sized to fit through the eye portion 62 but not the slot portion 64.

The anchor piece 54 also comprises a secondary bridge 66 extending along the top of the anchor piece 54 substantially perpendicular to the strings 31. The secondary bridge 66 is a raised ridge on the top of the anchor piece 54. Bridge 66 is sized so as to support the strings 31 such that the strings form an angle facing the bridge 66 of less than 180°. It should be understood that not all of the strings 31 will form this angle. For example, as shown in the figures, the E string, which is in communication with the fine tuning knob 56.

Figure 8:
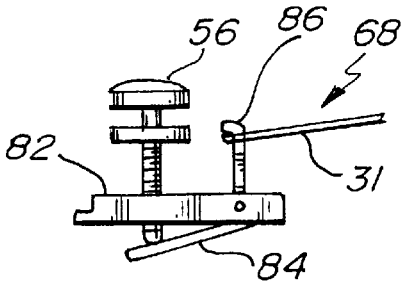
FIG. 8 is a side view of a fine tuning mechanism.

In the embodiment shown, as mentioned above, the E string is connected to a fine tuning mechanism 68, best illustrated in FIG. 8. These fine tuning mechanisms may be constructed in various manners. Such mechanisms are well known. It should be understood that the mechanism should be adaptable to fit and work with the anchor piece 54. It should also be understood that the present invention contemplates not having a fine tuning mechanism or combinations of one or more mechanisms on any of the strings.

FIGS. 3–4 show further perspectives of the anchor piece 54. In FIG. 4, the ringlets 60 and the bottom portion of the fine tuning mechanism 68. FIG. 3 also illustrates a violin with only one sound hole 70. The positioning and shape are generally as shown. The shape may vary from the generally oval or kidney shape as shown to the classic f-shape.

Figure 5:
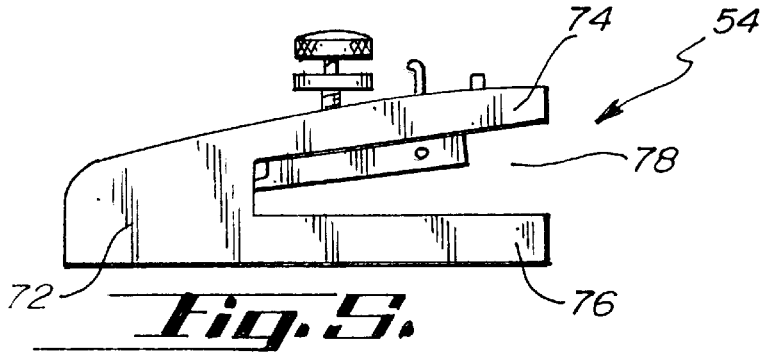
FIG. 5 shows a side view of the an embodiment of the present invention.

FIG. 5 shows a side view of the anchor piece 54 illustrating the various portions. As can be seen from this profile perspective, the piece 54 is generally C-shaped. The piece 54 comprising a base 72, a top base extension 74 and a bottom base extension 76. As can be seen, the extensions 74 and 76 extend forward from the base 72 forming a gap 78.

Figure 6:
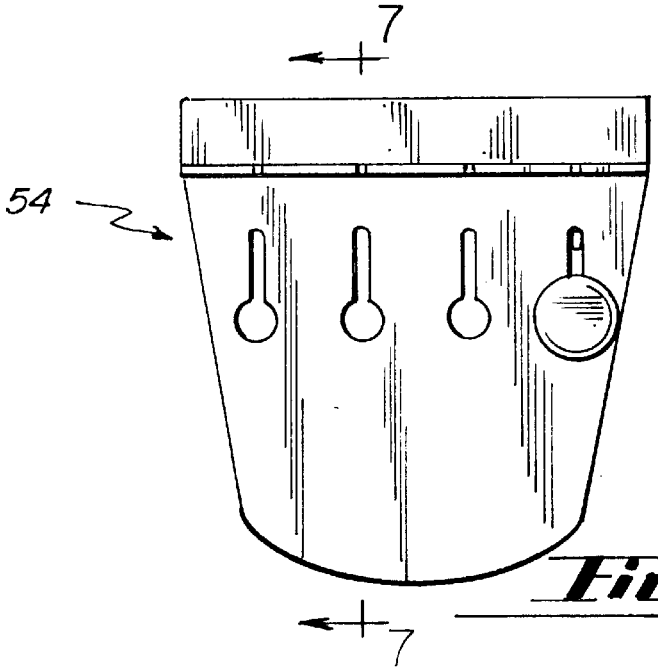
FIG. 6 shows a top view of the an embodiment of the present invention.

FIG. 6 shows a top view of the anchor 54, illustrating the keyhole slots 58, the secondary bridge 66 and the fine tuning knob 56. The device from the top is generally shaped in a form resembling a truncated triangle, however, it should be understood that the shape may vary.

Figure 7:
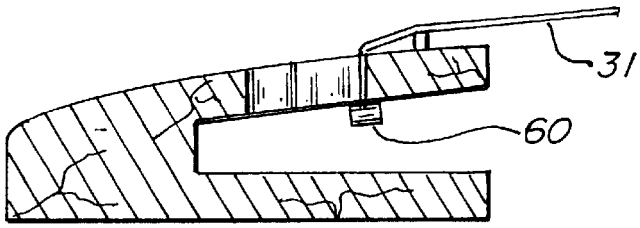
FIG. 7 is a cross-sectional view along lines 7—7 in FIG. 5.

FIG. 7 is a cross-section view along lines 7—7 in FIG. 6. In this figure, the securement of a string 31 may be seen. The opening is a crossing section of a keyhole slot 58.

FIG. 8 shows a side view of an example of a fine tuning mechanism 68. The knob 56 is screwed into a hole or slot of a stabilizing bar 82, which is secured within or under the top base extension 75. A hinge arm 84 is pivotably connected to the end of the bar 82. A hook 86 is connected to the end of the arm 84 at a fixed angle. When the knob 56 is screwed down, the end of the arm 84 is forced down, drawing the hook 86 inward, tightening the string 31.

If not described in detail above, the proportions and relative construction of the embodiments may be interpreted from the figures. Any inconsistencies between the figures and the description should be seen as alternative embodiments. Variations in the relative construction which do not change the inventive concepts presented herein are contemplated as possible embodiments of the invention.

The above examples and disclosure are intended to be illustrative and not exhaustive. These examples and description will suggest many variations and alternatives to one of ordinary skill in this art. All these alternatives and variations are intended to be included within the scope of the claims, where the term "comprising" means "including, but not limited to". Those familiar with the art may recognize other equivalents to the specific embodiments described herein which equivalents are also intended to be encompassed by the claims. Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each single dependent claim format which creates a dependency from a prior antecedent-possessing claim other than the specific claim listed in such dependent claim below (e.g. claim 6 may be taken as alternatively dependent from any of claims 2–5, claim 4 may be taken as alternatively dependent from claim 3; etc.).

What is claimed is:

1. A stringed instrument, the instrument being chosen from the group consisting of a cello, a string bass and a violin, the instrument comprising a hollow sound box having a first end and a second end, a finger board connected to the sound box at the fist end of the sound box, an anchor piece and a plurality of strings, the strings having first ends and second ends, wherein the first ends of the strings are connected to the finger board and the second ends are connected to the anchor piece, the sound box having a top plate and a bottom plate, wherein the top plate is between the bottom plate and the anchor piece, the top plate having a top surface generally facing away from the bottom plate and a bottom surface generally facing the bottom plate, the top surface having a periphery, wherein the anchor piece is connected to the top surface, the anchor piece comprising a base, top base extension and a bottom base extension, the top base extension and the bottom base extension extending from the base forming a gap between the too base extension and the bottom base extensions wherein the bottom base extension is positioned on the top surface of the to plate.

2. The stringed instrument of claim 1, wherein the anchor piece is completely within the periphery of the top surface.

3. The stringed instrument of claim 2, further comprising a bridge mounted on the top surface of the top plate between the anchor piece and the finger board, wherein the strings cross the bridge and are urged down on the bridge.

4. The stringed instrument of claim 3, the anchor piece having a top portion, wherein the anchor piece comprises a secondary bridge on the top portion, such that at least two of the strings bend over the secondary bridge.

5. The stringed instrument of claim 3, the anchor piece further comprising a fine tuning mechanism connected to one of the strings for fine tuning the one of the strings.

6. The stringed instrument of claim 5, wherein there is more than one fine tuning mechanism associated with the anchor piece.

7. The stringed instrument of claim 3, wherein the anchor piece is adhered to the top plate.

8. The stringed instrument of claim 3, wherein the anchor piece is screwed to the top plate.

9. The stringed instrument of claim 3, further comprising no more than one sound hole.

10. The stringed instrument of claim 9, wherein the sound hole is between the bridge and the side periphery of the top plate.

11. The stringed instrument of claim 1, the top base extension comprising a plurality of holes through which the ends of at least two of the strings extend.

12. The stringed instrument of claim 11, wherein the anchor piece comprises 3 holes and one fine tuning mechanism to receive and secure the plurality of strings.

13. The stringed instrument of claim 11, wherein the holes are keyhole shaped having a first portion and a second portion, wherein the second portion comprises a relatively narrower opening than the first portion.

14. The stringed instrument of claim 13, wherein the ends of the strings are connected to stoppers, the stoppers being wider that the opening of the second portion.

15. The stringed instrument of claim 14, wherein the stoppers are between the top base extension and the bottom base extension.

16. The string instrument of claim 15, wherein the stoppers are rings, to which the ends of the strings are attached.

17. The stringed instrument of claim 11, the anchor piece having a top portion, wherein the anchor piece comprises a secondary bridge on the top portion, such that at least two of the strings bend over the secondary bridge.

18. The stringed instrument of claim 17, the anchor piece flier comprising a fine tuning mechanism connected to one of the strings for fine tuning the one of the strings.

19. The stringed instrument of claim 1, wherein a cross-section of the combined base, the top base extension and the bottom base extension is U-shaped.

* * * * *

UNITED STATES PATENT AND TRADEMARK OFFICE

CERTIFICATE OF CORRECTION

PATENT NO. : 6,703,545 B2
DATED : March 9, 2004
INVENTOR(S) : Matthew A. McPherson It is certified that error appears in the above-identified patent and that said Letters Patent is hereby corrected as shown below:

Title page,
Item [75], Inventor, change "McFerson" to -- McPherson --

Signed and Sealed this

Twenty-second Day of June, 2004

JON W. DUDAS
*Acting Director of the United States Patent and Trademark Office*